United States Patent [19]

Attal

[11] Patent Number: 5,042,548

[45] Date of Patent: Aug. 27, 1991

[54] CORNICE FOR A WINDOW COVERING HEADRAIL

[75] Inventor: Lucien Attal, Anaheim, Calif.

[73] Assignee: Home Fashions, Inc., Westminster, Calif.

[21] Appl. No.: 447,544

[22] Filed: Dec. 7, 1989

[51] Int. Cl.[5] ..... E06B 9/00

[52] U.S. Cl. ..... 160/38; 160/21

[58] Field of Search ..... 160/38, 39, 19, 21

[56] References Cited

U.S. PATENT DOCUMENTS

| | | | |
|---|---|---|---|
| 2,708,711 | 5/1955 | McGinty | 160/19 |
| 4,085,480 | 4/1978 | Kromm | 160/38 |
| 4,254,813 | 3/1981 | Vecchiarelli | 160/19 |
| 4,384,605 | 5/1983 | Schaeffer | 160/19 |
| 4,662,421 | 5/1987 | Basmadji | 160/38 |
| 4,828,002 | 5/1989 | Ashby | 160/38 |
| 4,840,216 | 6/1989 | John | 160/38 |

*Primary Examiner*—Reinaldo P. Machado
*Attorney, Agent, or Firm*—George J. Netter

[57] ABSTRACT

A window covering headrail cornice has a front panel; two end plates; two corner pieces joining the end plates to the front panel; and end covers all fitted together, and unitarily secured to the headrail via clips interrelating the cornice to the front panel.

14 Claims, 6 Drawing Sheets

FIG. 7
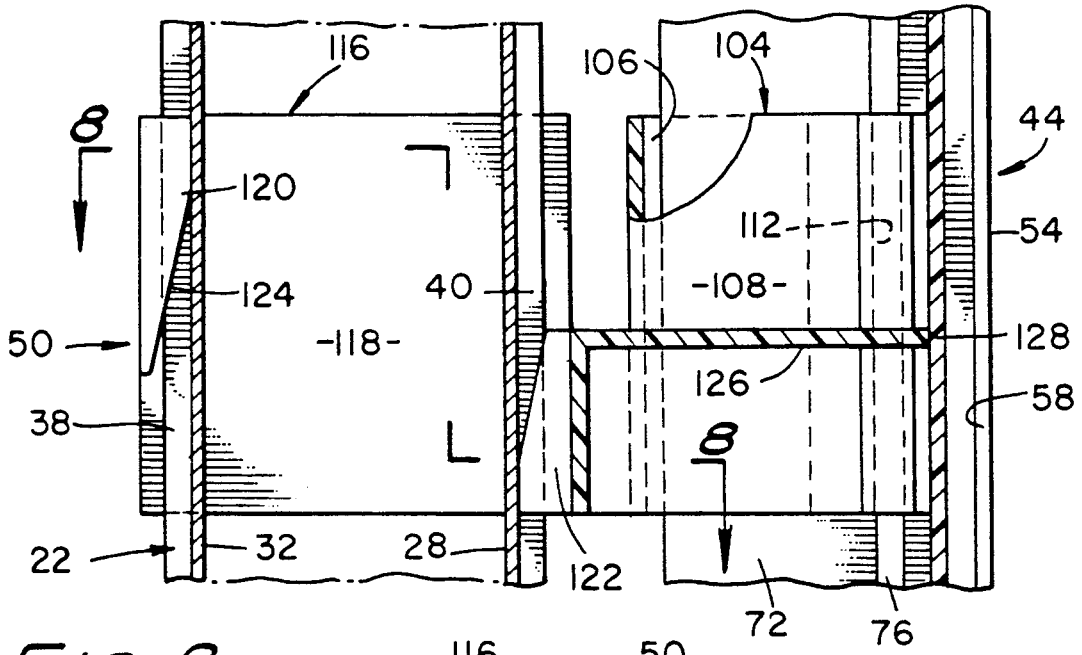
FIG. 8
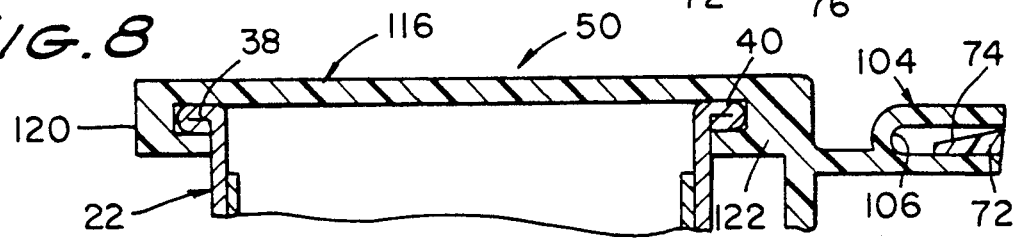
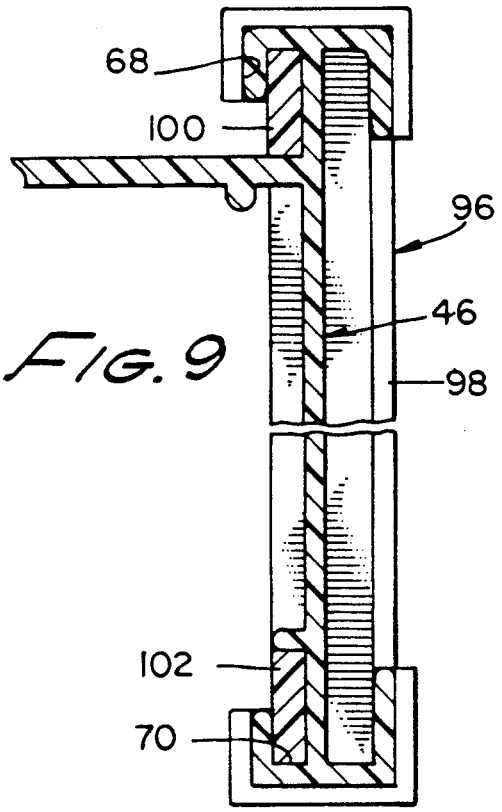
FIG. 9
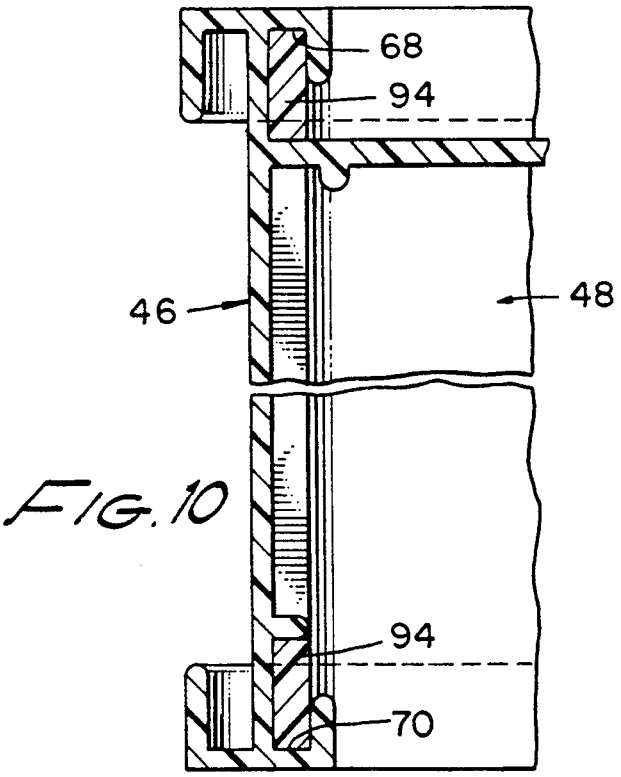
FIG. 10

54
96
130
132
134
136
138
140
142
144
146
148
150
152
56
60
62
66
68
70
14
15
16

CORNICE FOR A WINDOW COVERING HEADRAIL

BACKGROUND OF THE INVENTION

1. Field of the Invention

The present invention pertains generally to hanging coverings for windows, and, more particularly, to an improved means enclosing and ornamenting the headrail from which the window coverings hang and which means are sometimes referred to as a cornice.

2. Description of Related Art

A number of different kinds of present day window coverings hang from a headrail secured to a vertical wall surface or to the ceiling of a room, which headrail generally includes an elongated metal or plastic housing having an open top. Exemplary of such a window covering is the well-known "venetian blind" which has a number of slats that can be manipulated by cords for varying the amount of light to pass through the blind, or for raising and lowering the blind to a desired height. Another variety of window covering has an extent of flexible pleated material which can be raised or lowered to any desired vertical position, the window covering material folding onto itself along the pleat lines.

In the past, the headrail for a window covering unit has been enclosed by a cornice integrally secured to the headrail so that when the unit is assembled to the headrail, the headrail, cornice and blind are a unit. Also, sometimes the cornice is attached to the vertical wall only, or occasionally to both the wall and the headrail. These arrangements are impractical for a good many mounting sites in that the presence of the cornice may make the headrail assembly difficult to mount to the wall or ceiling. Also, an adjoining wall may reduce the available end space which could leave the ends of the window covering spaced inwardly resulting in a window portion not being covered, for example. Still further, these known arrangements tend to be rather bulky and heavy, and do not, for that reason, lend themselves to easy replacement in the event of damage, nor are they readily taken down for cleaning.

SUMMARY OF THE INVENTION

A typical headrail for the window covering to which the cornice to be described is mounted, has an elongated, hollow metal or plastic housing with an open top, and is U-shaped in cross-section with a front wall, a lower or bottom wall and a back wall. The headrail is secured in a suitable manner (e.g., screws) to a vertical wall surface or ceiling from which it is desired to hang the window covering unit.

The major parts of the cornice to be described are: a front panel; two end plates; two corner pieces joining the end plates to the front panel; and end covers. These different parts can be releasably snapped together to form a one-piece cornice which can be mounted via two or more special clips to be described to the headrail.

The front panel is an elongated molded or extruded plastic member having forwardly extending top and bottom flanges integral with the front panel. Slots are formed in each side of the facing portions of the flanges within which one or more flexible slats can be slidingly received. The slats can be of any desired color or surface design and in the case of a venetian blind, for example, may be one of the slats from which the blind is made thereby providing full color coordination.

The front panel back surface includes a pair of longitudinally extending, parallel slotlike openings extending the full length of the panel along the opposite edges respectively. A platelike locking key extends from the front panel rear surface for engagement with the headrail mounting clip to be described.

Each corner piece has two parts that dove-tail together forming a unitary corner piece. A corner piece part has a first insert dimensioned and positioned so that with the two parts are assembled together the inserts, respectively, fit into the front panel slotlike openings releasably securing the front panel and corner pieces together. A second insert extends at 90 degrees to the first insert for a purpose to be described.

Each end plate can be constructed identical to the front panel except that it is of shorter length. The end plates are fitted onto the corner piece second inserts for releasable securement to the corner pieces and front panel.

Separate end covers have inserts for receipt within the open ends of the slotlike openings in the end plates.

A mounting clip is a molded or extruded plastic member having first parts enabling sliding receipt over the upper edges of the headrail and a forwardly facing slot for receiving the front panel platelike locking key. A groove adjacent the clip forwardly facing slot receives a bead on the front panel key for locking the clip to the front panel.

BRIEF DESCRIPTION OF THE DRAWING

In the accompanying drawing:

FIG. 7 is a bottom plan sectional view along the line 7—7 in FIG. 3;

FIG. 8 is an end elevational, section viewed along line 8—8 of FIG. 7;

FIGS. 9 and 10 are elevational sectional views taken of FIG. 3;

DESCRIPTION OF PREFERRED EMBODIMENTS

Figure 1:
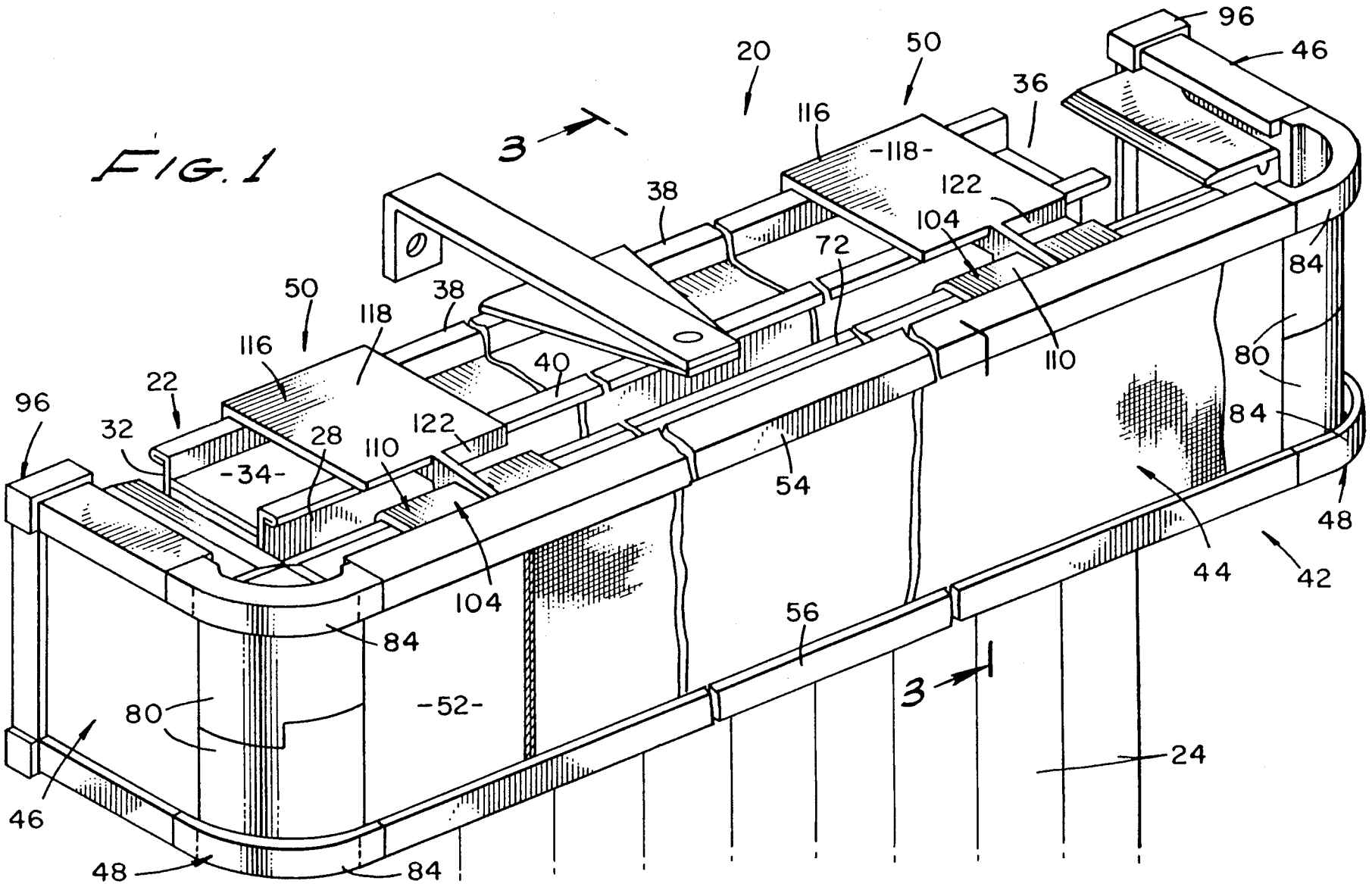
FIG. 1 is a perspective view of the cornice of this invention shown fully assembled onto a window covering headrail.

With reference now to the drawings and especially to FIG. 1, a window covering of the variety with which the cornice to be described has particular advantages, is enumerated generally as 20, and is seen to include a headrail 22 for mounting to a convenient wall surface and from which a plurality of slats 24 hang downwardly in a conventional manner. Manipulation of the cords or an adjustment wand (not shown) permits locating the blind at any desired degree of light admission and visibility. Other forms of window covering units with which the present invention may be advantageously employed also include the pleated fabric type which may be manipulated similarly as a venetian blind to any desired vertical position, the fabric folding onto itself along pleat lines.

Figure 2:
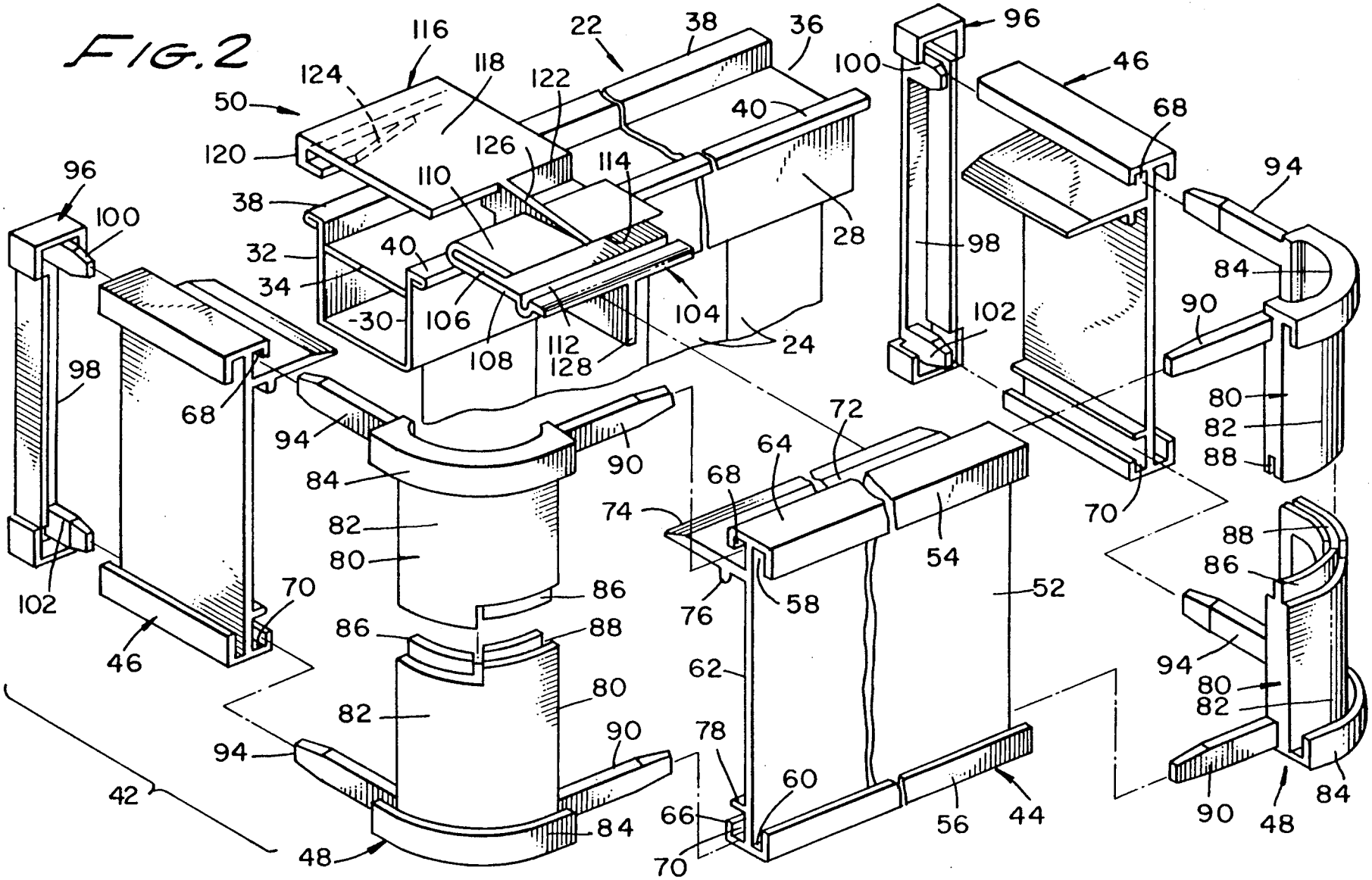
FIG. 2 is a perspective view similar to FIG. 1 showing the cornice parts in exploded relation.

Headrail 22 may take a variety of forms and still be amenable to use in the present invention. A preferred form of headrail 22 shown in FIGS. 1 and 2 is a hollow housing of metal or plastic having a front wall 28, a bottom wall 30, a back wall 32, mid wall 34, and an open top 36. The upper edges of the front and back walls are rolled outwardly to form flanges 38 and 40. Among other things, the headrail typically has openings via which threaded means pass for securing the headrail to a wall surface.

The cornice of this invention, depicted assembled in FIG. 1 and disassembled in FIG. 2, is enumerated generally as 42 and is seen to include in its major parts: a front panel 44; two end plates 46, and two corner pieces 48. A mounting clip 50, the details of which will be given later, releasably connects the cornice and headrail together.

The front panel 44 is an elongated, generally rectangular member constructed of extruded plastic, for example, having on its front or outwardly facing major surface, a centrally located relatively flat surface area 52 defined by upper and lower edge flanges 54 and 56, respectively, which extend forwardly of the flat surface 52 a slight amount. The two flange ends are formed toward each other to produce slots 58 and 60, respectively, for a use to be described.

The rear surface of the front panel includes a central portion 62 which is flat and coplanar with the front surface 52. The upper and lower flanges 54 and 56 have complementary identically shaped flanges 64 and 66 extending to the rear of the front panel. As in the front flanges, these rearward facing flanges have turned edges forming rectangular slots 68 and 70.

An insert wall 72 extends at 90 degrees from the rear surface 62 at a point spaced from the maximum reaches of flange 64. The wall 72 extends rearwardly substantially beyond the outer edge of the flange 64 and has a tapered outer edge portion 74. A beadlike rib 76 projects from the lower surface of wall 72 at a point spaced from the rear surface 62 and parallel thereto.

At a point spaced just above the lower flange 66 a riblike projection 78 extends rearwardly over the lower slot 70.

Corner pieces 48 are provided to fit onto opposite ends of the front panel 44 and they are identical to each other. In turn, each corner piece is formed from two identical molded or extruded plastic parts 80 which, in a way that will be described, are martise tenon fitted together to form a unitary corner piece.

Each corner piece part 80 is a molded plastic member having the overall shape of a cylindrical section of substantially 90 degrees. The outer major surface 82 is curved and has a similarly curved flange 84 along one end which is dimensionally the same as the front wall flanges 54 and 56 such that when placed adjacent a front wall flange they will appear continuous. The edge opposite that with the flange has a curved insert plate 86 and a similarly shaped slotted recess 88 located immediately adjacent. When two corner piece parts are assembled together the insert plate 86 of one part is received within the slotted recess 88 of the other part as a tenon in a mortise to secure the parts together.

A corner part lateral edge has a flat surface and includes a generally rectangular first tenon 90 extending therefrom having a tapered end portion 92. The tenon 90 is so dimensioned and located as to enable fitting receipt within a front wall slot 68 or 70, as the case may be. The opposite edge is also flattened and has a second tenon 94 extending therefrom which can be identical in geometry and dimensions to tenon 90.

With two corner piece parts assembled to form a corner piece, the corner piece may now be fitted onto the end of the front wall 28 with the tenons 90 and 94 received within slots 68 and 70. When fully assembled the corner piece curved surface 82 is continuously related to the front wall surface 52 as are the edge flanges.

The side plates 46 are constructed identically to the front wall 28, differing only in having a shorter length. A side plate 46 is assembled onto a corner piece by having the second tenons 94 received within the flange slots in the same way the front wall was mounted to the corner pieces.

The outermost end of each side plate 46 is finished off by a removable cover 96. More particularly, each cover an elongated generally I-shaped body 98 of dimensions suitable to fit over the open end of a side plate 46. First and second tenons 100 and 102 extend from the same surface of 98 for receipt within slots 68 and 70, respectively, of the side plate.

Figure 3:
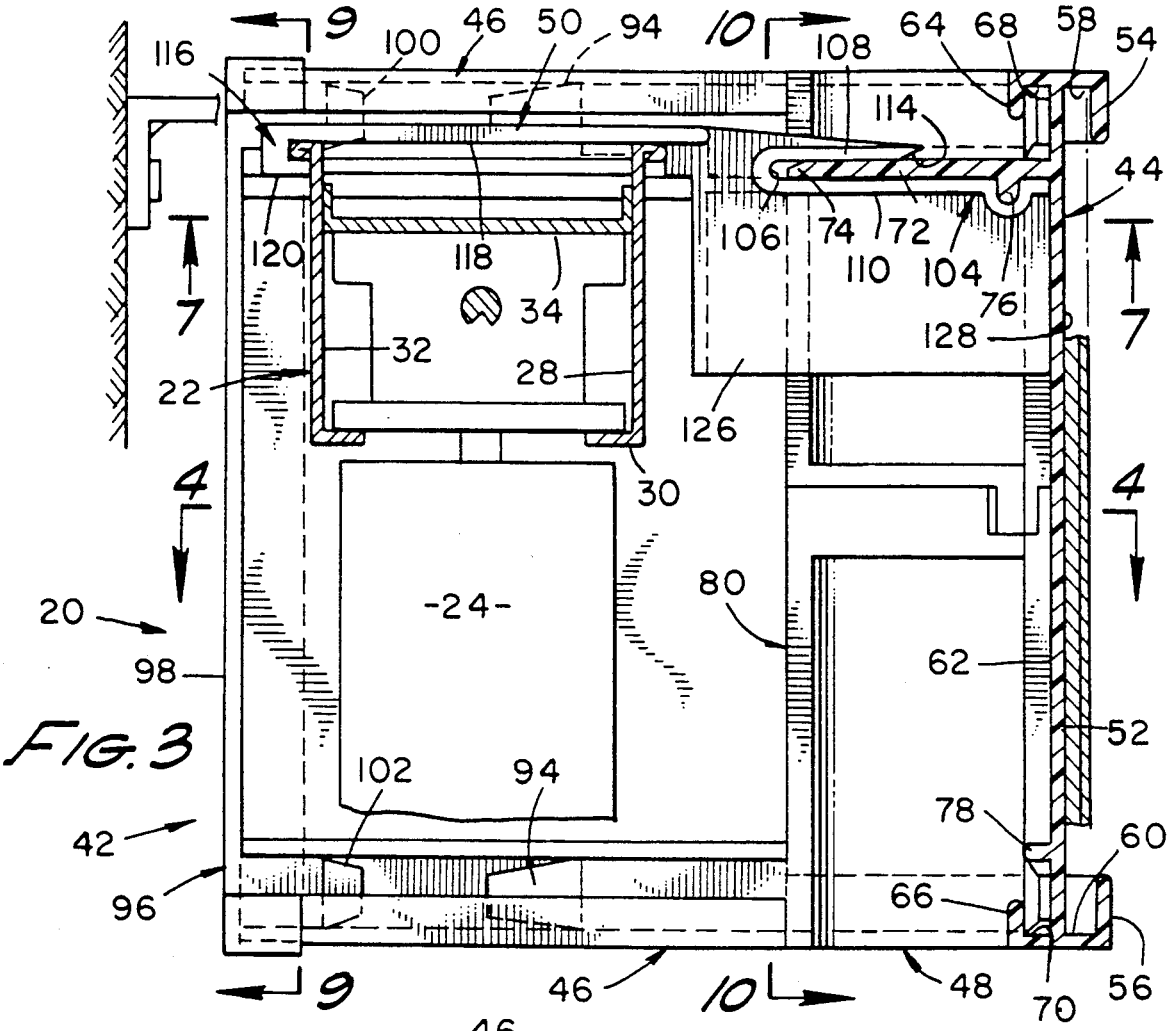
FIG. 3 is a side elevational, sectional view taken along the line 3—3 of FIG. 1.
Figure 4:
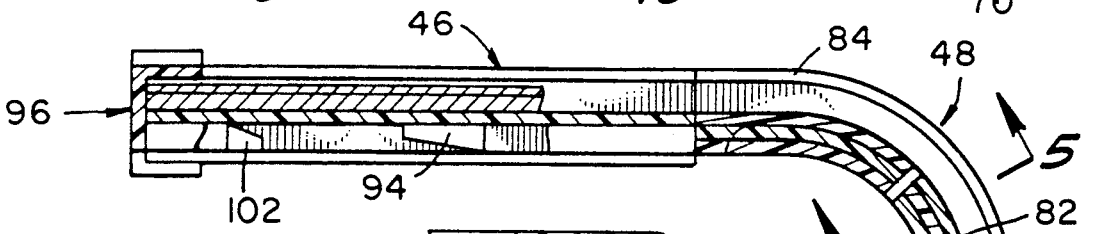
FIG. 4 is a top plan, sectional view along line 4—4 of FIG. 3.
Figure 5:
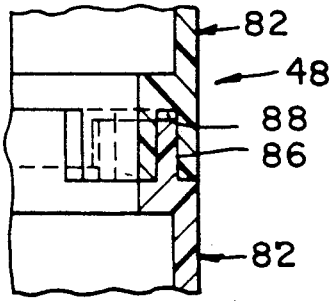
FIG. 5 is a detail sectional view of the corner taken along 5—5, in FIG. 4.
Figure 6:
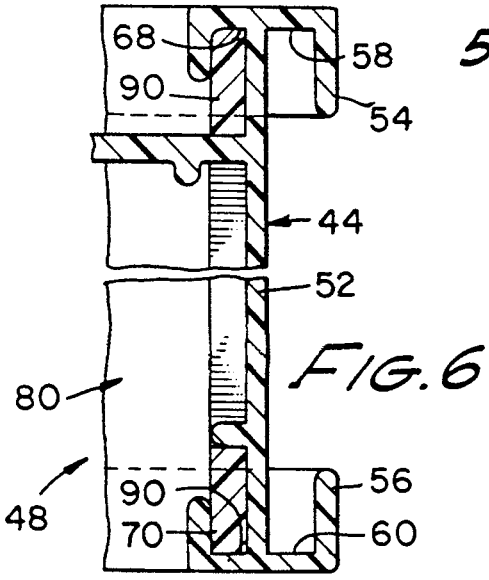
FIG. 6 is an elevational sectional view taken through the front, panel as depicted in FIG. 4.

For the ensuing description of the clip 50 used to removably secure the cornice 42 to the headrail 22 reference is now made especially to FIGS. 2 and 3. A clip first part 104 for effecting connection to the front panel 44 consists of a molded or extruded plastic generally rectangular strip folded onto itself forming an elongated slotlike opening 106. The lower wall 108 extends outwardly farther than the upper wall 110 and includes an upwardly facing groove 112 outwardly of the outer edge of 110. The upper wall 110 has its edge portion tapered at 114 toward the wall edge.

A second part 116 of the clip 50 for interconnecting directly with the headrail is also constructed of molded or extruded plastic and includes a rectangular body 118. The body outer edge portion is turned downward and back to form a hooklike member 120 dimensioned for sliding and locking receipt onto headrail flange 38. The opposite edge of body 118 has a downwardly turned edge wall 122 parallel to the member 120 with the internal spacing between member 120 and 122 slightly greater than the maximum dimensions across the two headrail flanges 38. The hooklike member lower wall is tapered at 124 to aid in mounting as will be described. The two clip parts 104 and 116 are unitarily related by a transverse rib 126.

The clip 50 is first mounted onto the headrail by sliding the hooklike member 120 onto the outer flange 38 and pressing the wall 122 against the other flange 40 so that the clip second part 116 is tightly secured to the headrail with the clip first part 104 facing toward the side on which the cornice is to be mounted. The front panel insert wall 72 then has its tapered edge portion 74 pressed into the clip slotlike opening 106 until the riblike projection 78 locks into groove 112. The front panel is now mounted to the headrail by the clip. In actual practice there will usually be at least two, and sometimes more, clips used with mounting of each being accomplished as already described.

It is to be noted by comparison of FIGS. 2 and 3 that when the front panel 44 is full received on a clip 50, the clip lower wall outer edge contacts the panel rear surface 62 as does a leading edge of 128 of the rib 126. This arrangement secures the cornice in place on the headrail and avoids looseness which could cause the cornice to sag or become twisted with respect to the headrail.

Figure 11:
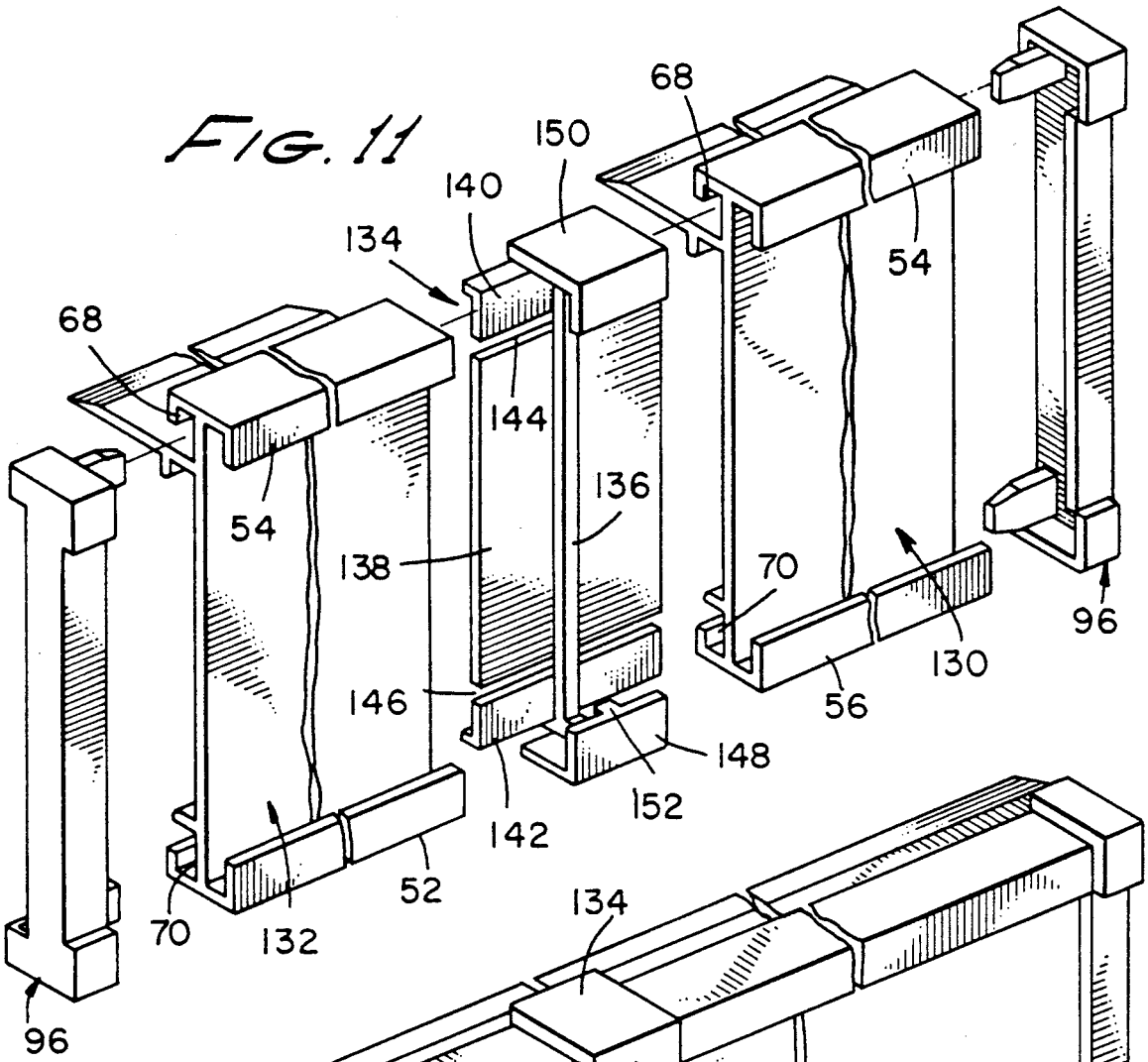
FIGS. 11 and 12 are perspective views of an alternate form of cornice front panel.
Figure 12:
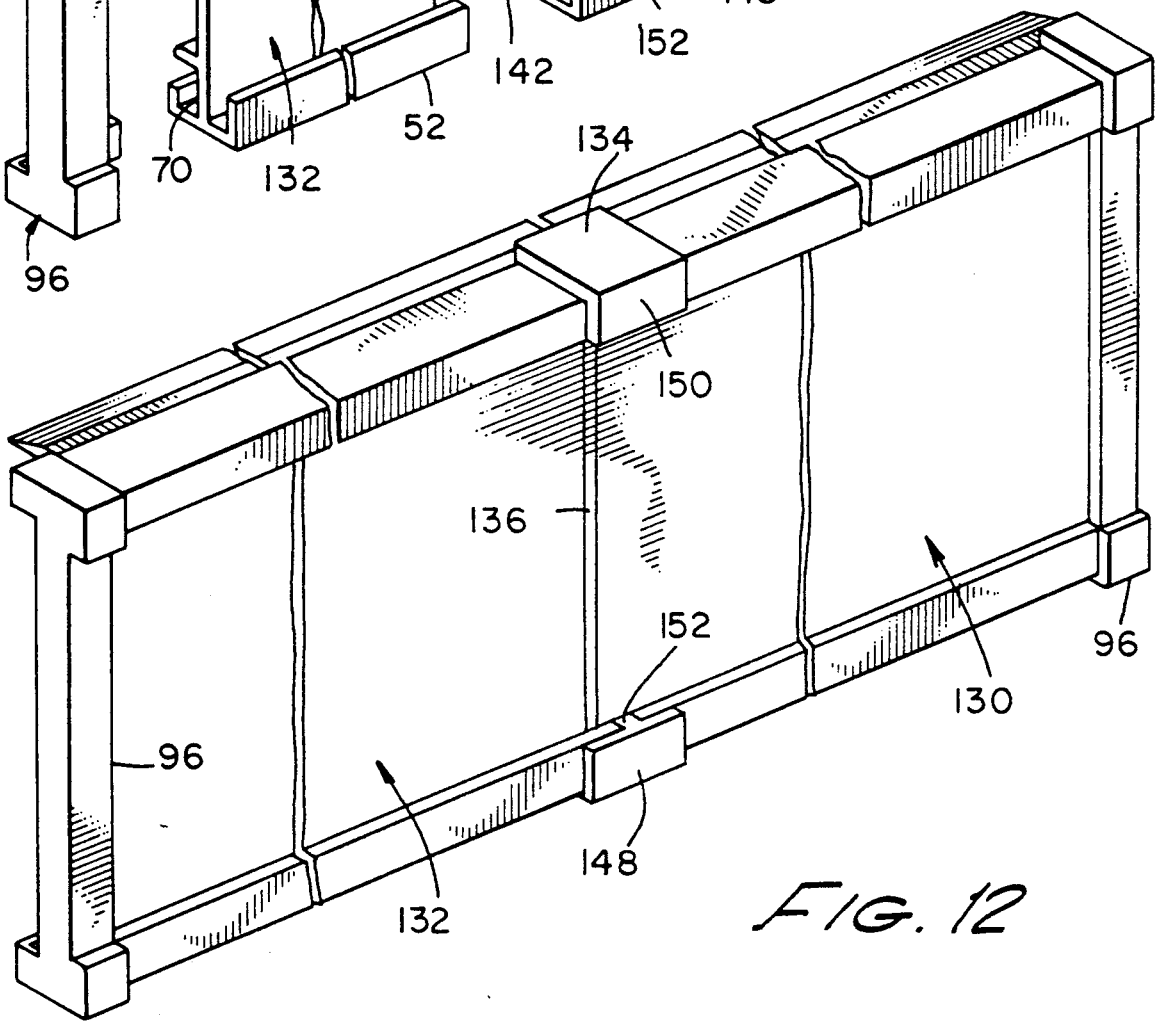
Figures 13, 14, 15, 16:
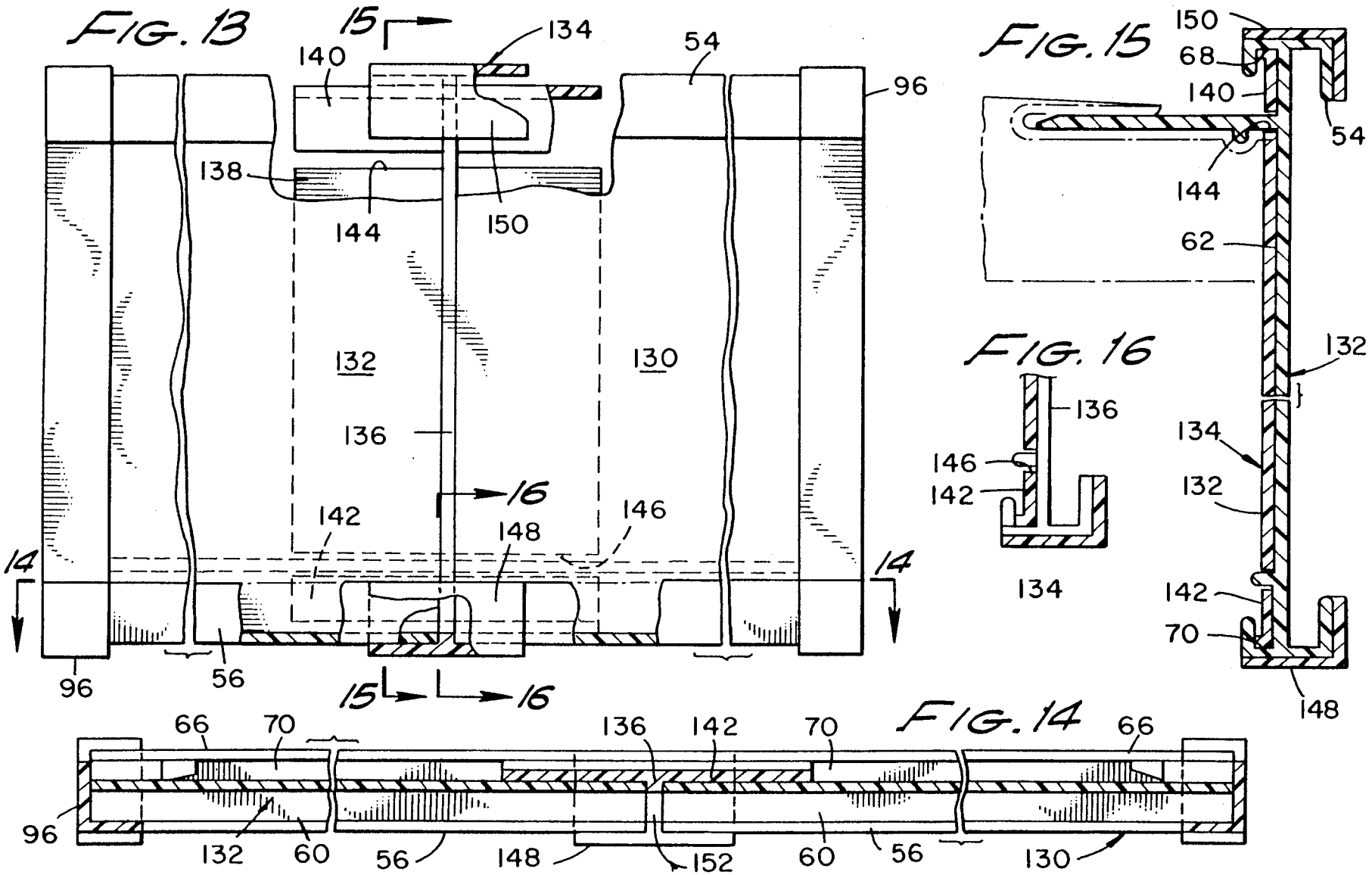
FIG. 13 is a front elevational, partially fragmentary view, of the FIG. 11 embodiment.
FIGS. 14–16 are sectional views taken in FIG. 13.

On occasion, a headrail may be exceptionally long so that a front panel of appropriate length is formed by interconnecting several shorter panel sections together. As shown in FIGS. 11 and 12 two front panel sections 130 and 132 are end connected by a panel link 134 to form an enlarged unitary front panel. The link includes a rectangular cross-section rod 136 having affixed to a rear surface a centrally located rectangular plate 138 and first and second members 140 and 142 L-shaped in cross-section. More particularly, the member 138 is spaced from the first L-shaped member at 144 and from the second L-shaped member at 146. The plate 138 and members 140, 142 are so arranged that when located adjacent the end of a front panel 44, the members 140 and 142 may be slid into slots 68 and 70, respectively, and the plate 138 is then located flush with the front panel rear surface 62. Further L-shaped members 148 and 150 are affixed to the upper and lower ends of rod 136 and so dimensioned to enable fittingly receiving an end portion of the flanges 54 and 56 of the two panel sections 130, 132 within the L-shaped members. More particularly, when the link is fully assembled to the two front panel sections, the ends of flanges 54 and 56 abut against opposite sides in a central rib 152 to lock the ends together. Also, at this time the side edges of the front panel abut against rod 136 with the additional support afforded by the interconnections of the members 138–142 already described.

For certain installations that extend from one wall surface to another, it may be advisable to leave off the corner pieces entirely and instead close off the outer ends of the front panel sections 130, 132 by covers 96. This would be primarily advantageous where the window to be covered includes substantially all of the wall space between two other opposing walls so that there would be insufficient space, or need, for corner pieces and side plates.

What is claimed is:

1. Window covering unit having a headrail, surface covering means hanging from the headrail, and a cornice mounted to the headrail, the cornice comprising:

an elongated front panel formed of plastic having a smooth flat front surface bounded by first and second flanges on opposite edges, an insert wall integral with said panel extending from a rear surface of the panel generally opposite the first flange and substantially normal to the panel smooth flat front surface, and a first slot on the panel rear surface opposite the first flange and a second slot on the panel rear surface opposite the second flange;

first and second corner pieces each composed of two identical parts unitarily fitted together, each corner piece part including a first tenon for being received within a front panel slot and a second tenon extending in a direction substantially 90 degrees to the first tenon;

first and second end plates, each constructed identically to the front panel, having their first and second slots received respectively on the second tenons fo the corner piece parts; and clip means mounted on the headrail having a slotlike opening within which the front panel insert wall is received.

2. Window covering unit as in claim 1, in which the corner piece parts each have an insert plate and slotted recess, the two corner piece parts being unitarily joined together by the receipt of the insert plate of one corner piece part within the slotted recess of the other corner part.

3. Window covering unit as in claim 1, in which the clip means further includes a groove, and the front panel insert wall has a beadlike rib which is located within said groove.

4. Window covering unit as in claim 1, in which a riblike projection extends from the front panel rear surface and is spaced from the second slot for preventing a corner piece first tenon from moving out of said second slot except in a direction parallel to said slot.

5. Window covering unit as in claim 1, in which a cover is releasably positioned over the outer end of each end plate.

6. Window covering unit as in claim 1, in which the clip means includes:

a first part having a lower wall separated from an upper wall defining the slotlike opening, the lower wall having the groove formed therein;

a second part having a rectangular body with an edge portion formed into a hooklike member and an opposite edge formed into a downwardly turned edge wall, said hooklike member and downwardly turned edge wall clampingly engaging the headrail; and a rib unitarily interconnecting the said first and second parts.

7. Window covering unit with a headrail, a wall surface cover hanging from the headrail, and a cornice, the cornice comprising:

an elongated front panel formed of plastic having a smooth flat front surface bounded by first and second flanges on opposite edges, an insert wall with a. beadlike rib integral with said panel extending from a rear surface of the panel generally opposite the first flange and substantially normal to the panel smooth flat front surface, and a first slot on the panel rear surface opposite the first flange and a second slot on the panel rear surface opposite the second flange;

first and second corner pieces each composed of two identical parts unitarily fitted together, each corner piece part including a first tenon for being received within a front panel slot and a second tenon extending in a direction substantially 90 degrees to the first tenon, an insert plate and slotted recess, the two corner piece parts being unitarily joined together by the receipt of the insert plate of one corner piece part within the slotted recess of the other corner part;

first and second end plates, each constructed identically to the front panel, having their first and second slots received respectively on the second tenons of the corner piece parts; and clip means mounted on the headrail having a slotlike opening within which the front panel insert wall is received, said clip means further having a groove within which the beadlike rib is received.

8. Window covering unit as in claim 7, in which a riblike projection extends from the front panel rear surface spaced from the second slot for preventing a corner piece first tenon from moving out of said second slot except in a direction parallel to said slot.

9. Window covering unit as in claim 7, in which a cover is releasably positioned over the outer end of each end plate.

10. Window covering unit as in claim 7, in which the clip means includes:

a first part having a lower wall separated from an upper wall defining the slotlike opening, the lower wall having the groove formed therein;

a second part having a rectangular body with an edge portion formed into a hooklike member and an opposite edge formed into a downwardly turned edge wall, said hooklike member and downwardly turned edge wall clampingly engaging the headrail; and the beadlike rib unitarily interconnecting the said first and second parts.

11. A cornice for mounting onto a headrail window covering unit having wall surface covering means hanging from the headrail, comprising:

an elongated front panel formed of plastic having a smooth flat front surface bounded by first and second flanges on opposite edges, an insert wall integral with said panel extending from a rear surface of the panel generally opposite the first flange and substantially normal to the panel smooth flat front surface, and a first slot on the panel rear surface opposite the first flange and a second slot on the panel rear surface opposite the second flange;

first and second corner pieces each composed of two identical parts unitarily fitted together, each corner piece part including a first tenon for being received within a front panel slot and a second tenon extending in a direction substantially 90 degrees to the first tenon, an insert plate and slotted recess, the two corner piece parts being unitarily joined together by the receipt of the insert plate of one corner piece part within the slotted recess of the other corner part;

first and second end plates, each constructed identically to the front panel, having their first and second slots received respectively on the second tenons of the corner piece parts;

clip means mounted on the headrail having a slotlike opening within which the front panel insert wall is received; and a cover releasably positioned over the outer end of each end plate.

12. A cornice as in claim 11, in which the clip means further includes a groove, and the front panel insert wall has a beadlike rib which is located within said groove.

13. A cornice as in claim 11, in which a riblike projection extends from the front panel rear surface and is spaced from the second slot for preventing a corner piece first tenon from moving out of said second slot except in a direction parallel to said slot.

14. Window covering unit as in claim 11, in which the clip means includes:

a first part having a lower wall separated from an upper wall defining the slotlike opening, the lower wall having the groove formed therein;

a second part having a rectangular body with an edge portion formed into a hooklike member and an opposite edge formed into a downwardly turned edge wall, said hooklike member and downwardly turned edge wall clampingly engaging the headrail; and a rib unitarily interconnecting the said first and second parts.

* * * * *